US007644692B2

(12) United States Patent
Kanafani et al.

(10) Patent No.: US 7,644,692 B2
(45) Date of Patent: Jan. 12, 2010

(54) VVT CONTROL METHOD DURING LOCK PIN DISENGAGEMENT

(75) Inventors: Fadi S. Kanafani, Windsor (CA); Patrick M. Foley, Brighton, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 186 days.

(21) Appl. No.: 11/773,794

(22) Filed: Jul. 5, 2007

(65) Prior Publication Data

US 2009/0007864 A1 Jan. 8, 2009

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 6,647,936 | B2 | 11/2003 | Lewis | |
| 6,810,843 | B2 | 11/2004 | Quinn, Jr. | |
| 6,814,038 | B2 | 11/2004 | Smith | |
| 2003/0200943 | A1 * | 10/2003 | Wada et al. ..... | 123/90.15 |

* cited by examiner

*Primary Examiner*—Zelalem Eshete
(74) *Attorney, Agent, or Firm*—Ralph E. Smith

(57) ABSTRACT

A control method for an internal combustion engine of a vehicle that is used with a variable valve timing (VVT) system to promote lock pin disengagement. The method establishes if the VVT is at a lock pin position, establishes if a lock pin is not disengaged out of an associated recess, and can control the rate of movement of the VVT away from the lock pin position so that the lock pin can be disengaged out of the recess.

20 Claims, 1 Drawing Sheet

VVT CONTROL METHOD DURING LOCK PIN DISENGAGEMENT

FIELD OF THE INVENTION

The present invention generally relates to controlling a variable valve timing (VVT) system for a vehicle engine, and more particularly to controlling the VVT when attempting to disengage a lock pin.

BACKGROUND OF THE INVENTION

Variable valve timing systems are commonly used with automotive internal combustion engines for controlling intake and exhaust valve opening and closing to improve fuel economy and engine performance. One type of a VVT system uses a phaser that can include a lock pin which, when engaged, locks the phaser in a particular phase angle. The lock pin is then disengaged to move the phaser to another phase angle. But sometimes the lock pin is not fully disengaged when attempting to move and can jam, stick, or otherwise be subjected to side-loading.

SUMMARY OF THE INVENTION

One implementation of a presently preferred method of controlling the movement of a phaser of a variable valve timing (VVT) system may include establishing if the phaser is at a lock pin position. The method may also include establishing if the lock pin is not disengaged out of a recess of the phaser when the phaser is commanded to move away from the lock pin position. Furthermore, the method may include rate limiting the movement of the phaser away from the lock pin position so that the lock pin can be disengaged out of the recess when the lock pin may have otherwise been jammed, stuck, or subjected to side-loading.

Another implementation of a presently preferred method of using a controller to control the phasing of a variable valve timing (VVT) system may include establishing if the VVT system is at a lock pin position. The method may also include establishing if a lock pin of the VVT system is not disengaged out of an associated recess of the VVT system. Furthermore, the method may include rate limiting a duty cycle of the VVT system to control the rate of movement of the VVT system so that the lock pin can be disengaged out of the recess when the lock pin may have otherwise been jammed, stuck, or subjected to side-loading.

And another implementation of a presently preferred method of controlling the movement of a phaser of a variable valve timing (VVT) system when disengaging a lock pin out of a recess may include establishing if the phaser is at a lock pin position. The method may also include suspending the use of a diagnostic system and establishing if the lock pin is not disengaged out of the recess when the phaser is commanded to move away from, the lock pin position. Furthermore, the method may include rate limiting a duty cycle of the VVT system in order to control the rate of movement of the phaser so that the lock pin can be disengaged out of the recess when the lock pin may have otherwise been jammed, stuck, or subjected to side-loading. Lastly, the method may include repeating the rate limiting for a predetermined number of duty cycles, or until the lock pin is disengaged out of the recess, whichever occurs first.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 2:
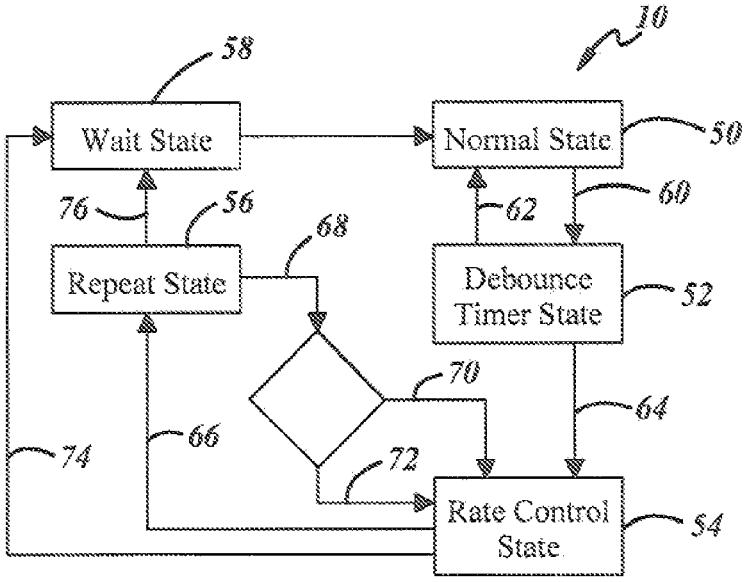
FIG. 2 is a flow chart showing one embodiment of a method that can be used to control the VVT of FIG. 1.

Referring in more detail to the drawings, FIG. 2 shows one embodiment of a control method 10 that can be used with a VVT system 12 to promote lock pin disengagement. In particular, the method 10 can repeatedly rate limit, or slow the rate of movement of the VVT 12 when the VVT is changing phase angles and moving away from a lock pin position where a lock pin 14 is aligned with a recess 16. In this way, the method 10 gives the lock pin 14 enough time to retract out of the recess 16, and reduces the likelihood that the lock pin jams, sticks, or is unduly side-loaded in the recess.

Figure 1:
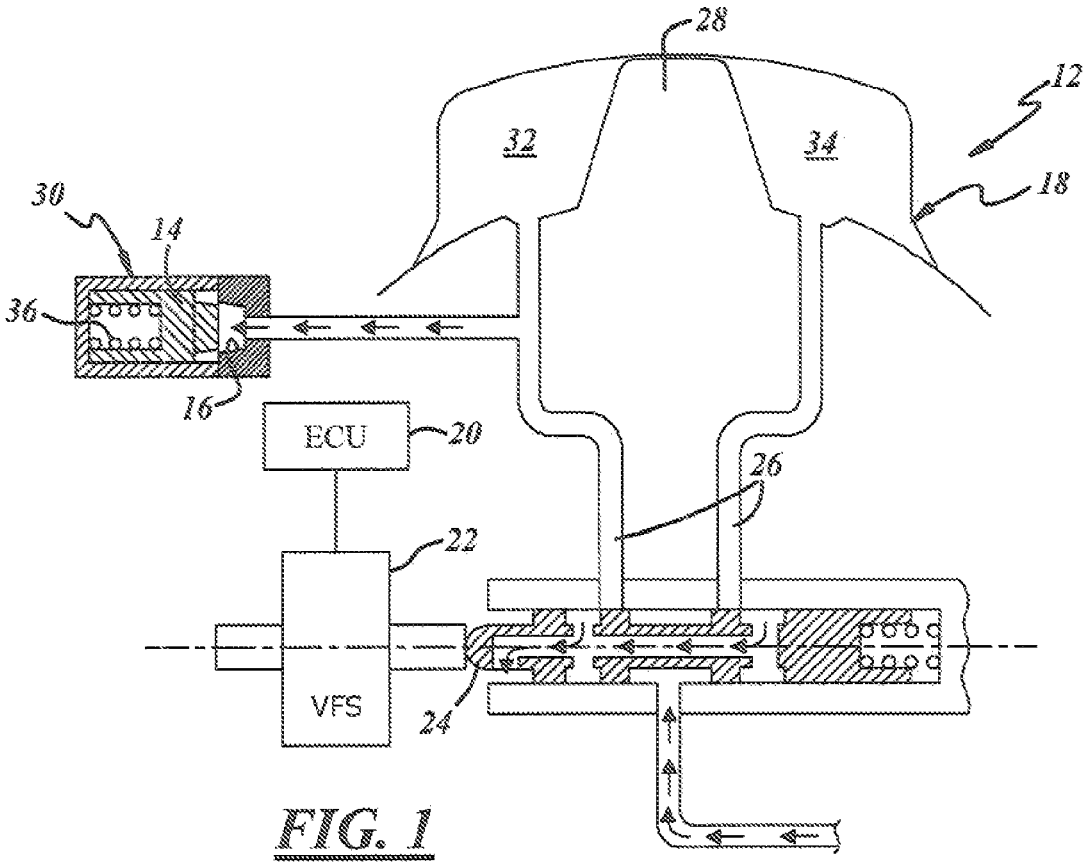
FIG. 1 is a schematic representing some components of a VVT system and showing a lock pin disengaged.

FIG. 1 schematically represents part of an exemplary VVT 12 that may be equipped on an automotive engine and used with the method 10. In general, the VVT 12 continuously controls intake and exhaust valve actuation (opening and closing) throughout an engine's operation. As shown, one example of a suitable VVT 12 includes a vane type phaser 18, but the method 10 can be used with other types of VVTs not shown. This particular phaser can control event-phasing, which describes a way of advancing or retarding a valve's actuation phase (measured in crank angle degrees, from when a valve opens to when it closes) with respect to a piston stroke relative to top-dead-center. The VVT 12 can include a controller such as an engine control unit (ECU) 20 that sends current to control a variable force solenoid (VFS) 22 which in turn drives a spool valve 24. The spool valve 24 regulates fluid flow through various fluid passages 26 to actuate both a vane 28 and a lock assembly 30 of the phaser 18. Fluid can be directed to either side, or both sides of the vane 28 in a first chamber 32 and a second chamber 34 to advance or retard the position of the vane. Skilled artisans will know the general construction, arrangement, and operation of these types of VVTs so a more complete description will not be given here.

The lock assembly 30 engages and disengages the phaser 18 to respectively lock and unlock the position of the phaser in a particular phase angle at the lock pin position. The lock assembly 30 commonly locks the phaser 18 at an engine start-up condition or idle condition, but the exact phase angle can depend on, among other things, the type of engine, in most cases, the lock assembly 30 will be engaged when the lock pin 14 lines up with the recess 16 while a biasing force exerted by a spring 36 to the lock pin exceeds an opposing hydraulic force exerted by the fluid in the fluid passages 26.

Turning now to FIG. 2, the method 10 is used in some circumstances to control the movement of the phaser 18 when the lock assembly 30 is being disengaged and the phaser is moving away from the lock pin position. In one embodiment, the method 10 comprises a source code composing a program that is loaded onto a programmable readable memory, such as that found in a controller like the ECU 20 or any other suitable memory or storage device or means. The source code instructs the ECU 20, in conjunction with one or more known closed-loop control techniques such as proportional-integral-derivative (PID) control, to perform various steps or commands which in turn controls the VVT 12 during lock pin disengagement. Among those steps include physical movement or rotation of the phaser 18, determinations, and calculations. Skilled artisans will appreciate the numerous programming languages that could be used for the source code, such as the C programming language, and thus the numerous embodiments or implementations that the source code could take. One example is given in FIG. 2 which shows, by flow chart, a graphical representation of the various states of the source code of the method 10. The method 10 may include a normal state 50, a debounce timer state 52, a rate control state 54, a repeat state 56, and a wait state 58—all with various transitions between them.

In the normal state 50, the VVT 12 is operating normally and the method 10 is otherwise not controlling any movement of the phaser 18 in this state. In other words, the ECU 20 is commanding the phaser 18 to advance and retard as it ordinarily would without the method 10. The lock assembly 30 may be disengaged in the normal state 50. Also, a duty cycle of the VVT 12 is cycling from 0-100% as it ordinarily would without the method 10. The duty cycle is, according to this embodiment, a percentage or proportion of current out of total current available, that the ECU 20 sends to the VPS 22 and that thus drives the spool valve 24. For example, at 0% the vane could be in one of fully advanced or fully retarded positions, and at 100% the vane would be in the other of the fully retarded or fully advanced positions. Similarly in the normal state 50, a diagnostic system (not shown) of the VVT 12 is monitoring the VVT as it ordinarily would without the method 10. The ECU 20 commands the diagnostic system to monitor the VVT 12 and, among other things, determine when a failure condition occurs and the cause of that failed condition. The diagnostic system requirement may in part be dictated by various emission parameters set forth by the U.S. Environmental Protection Agency (EPA) and/or the California Air Resources Board (CARB). Skilled artisans will know the general workings and execution of the duty cycle and the diagnostic system such that a more complete description is not given here.

Upon entry into the normal state 50, the source code may instruct the ECU 20 to perform various steps or commands. For instance, the ECU 20 may command no rate limiting, or in other words not command any control so that movement of the phaser 18 is not being rate limited. Also, a debounce timer (subsequently described) of the debounce timer state 52 may be cleared (reset to zero) so that residual timing from a previous cycle is not carried beyond this point. The ECU 20 may send a flag to the diagnostic system signaling that there is no rate limiting occurring and thus allowing the system to continue monitoring the VVT 12. Furthermore, a repetition counter may be cleared so that residual counting from a previous cycle is not carried beyond this point. The repetition counter counts the number of times that the duty cycle shaping has been repeated for rate limiting in the repeat state 56, or the number of times that the method 10 performs the rate control state 54 in a single cycle. Also upon entry into the normal state 50, the ECU 20 may send a flag signaling that the duty cycle should be cycling as it ordinarily would without the method 10.

Still referring to FIG. 2, a transition 60 may be provided, between the normal state 50 and debounce timer state 52 to furnish one or more condition(s), action(s), or both for entering the debounce timer state. One condition may include establishing that the phaser 18 is at the lock pin position. The position of the phaser 18 can be determined by a position sensor (not shown) located adjacent the phaser that relays the information to the ECU 20. Another condition may include establishing that the actual duty cycle sent from the ECU 20 is less than a predetermined enabling duty cycle, indicating that the biasing force of the spring 36 exceeds the opposing hydraulic force in the fluid passages 26 so that the lock pin 14 can be engaged in the recess 16.

The transition 60 may include one more condition such as establishing that, a global repetition counter is less than a global repetition counter limit, so that the total number of repeated cycles is less than a predetermined permissible number. The global repetition counter counts the total number of times that, the duty cycle has been repeated for rate limiting in the repeat state 56, or the number of times that the method 10 performs the rate control state 54 in all the cycles during a single trip when the engine is started until it is shut down. The global repetition counter limit can be set in view of the EPA and/or CARB regulations, and can vary from engine-to-engine and vehicle-to-vehicle. If the number of repeated cycles is greater than the permissible number, then in some embodiments the diagnostic system has been suspended for too long and it will be allowed to detect a failed condition where the particular engine is no longer meeting emission parameters set by the EPA and/or CARB. In that case, the VVT 12 will go back to and stay in the normal state 50. Likewise, another condition may include establishing that a global timer is less than a global timer limit so that the amount of lime that the VVT 12 uses to repeat rate limiting and to thus disengage the lock assembly 30 is less than a predetermined amount of time. The global timer clocks the total amount of time that the method 10 has been active in the repeat state 56, or that the method performs the rate control state 54 in all the cycles during a single trip. Like the global repetition counter limit described above, the global timer limit can be set in view of the EPA and/or GARB regulations, and can vary from engine-to-engine and vehicle-to-vehicle. And if the amount of time is greater than the predetermined amount of time, the VVT 12 will forced back to and stay in the normal state 50.

A transition 62 may also be provided between the normal state 50 and the denounce timer state 52 to furnish one or more condition(s), action(s), or both for entering back into the normal state. One condition may include establishing that the phaser is not at the lock pin position.

In the debounce timer state 52, the debounce timer measures the amount of time (such as by 0.005 second increments) that the phaser 18 has been located at the lock pin position. Upon entry, the source code may instruct the ECU 20 to perform various steps or commands. For instance, the ECU 20 may command no controlling, or in other words bypass race limiting so that the movement of the phaser 18 is nor rate limited.

A transition 64 may be provided between the debounce timer state 52 and the rate control state 54 to furnish one or more condition(s), action(s), or both for entering into the rate control state. The condition(s), action(s), or both may be used to establish, among other things, if the lock pin 14 is engaged in the recess 16. Accordingly, one condition may include establishing if the debounce timer has measured a sufficient amount of time to allow the lock pin 14 to engage the recess 16, and establishing if the hydraulic force in the fluid passages 26 is less than the biasing force of the spring 36 so that the lock pin 14 can be engaged in the recess 16. Or another condition may include establishing if the VVT 12 is at the engine start-up condition where the phaser 18 has yet to be phased. And another condition, which in some embodiments may be demanded to be met with one or both of the above conditions, may include establishing if the phaser 18 is commanded to move away from the lock pin position. One way of doing this is to establish that the phaser 18 is not being commanded to be at the lock pin position.

In the rate control state 54, based on the previous states and transitions, there is a possibility that the lock assembly 30 is jammed, stuck, or being side-loaded at the lock pin position. Upon entry, the source code may instruct the ECU 20 to perform various steps or commands. For instance, the ECU 20 may command, controlling the movement of the phaser 18 by using duty cycle rate limiting and a rate reduction multiplier. Rate limiting is one way of slowing the rate of movement of the phaser 18, but skilled artisans will appreciate other ways that the ECU 20 could rate limit and control the rate of movement of the phaser 18. In one embodiment, rate limiting refers to decreasing the duty cycle rate which can be measured in percent per second; and the rate reduction multiplier is a value used to decrease the duty cycle rate and thus the rate of movement of the phaser 18. The rate reduction multiplier can vary from engine-to-engine and vehicle-to-vehicle, and in most cases can be a function of the repetition counter. That is to say that the values determined for the rate reduction multiplier should permit an adequate number of repeated and rate limited cycles while simultaneously doing so within the predetermined amount of rime. Also upon entry into the rate control state 54, the ECU 20 may send a flag to the diagnostic system signaling that the phaser 18 is being rate limited and thus to suspend monitoring of the VVT 12 while the rate limiting is occurring. In other embodiments, the diagnostic system is not suspended while the rate limiting is occurring.

A transition 66 may be provided between the rate control state 54 and the repeat state 56 to furnish one or more condition(s), action(s), or both for entering into the repeat state. The condition(s), action(s), or both may be used to establish, among other things, if the lock pin 14 is not disengaged out of the recess 16 and thus again there is a possibility that the lock assembly 30 is jammed, stuck, or being side-loaded at the lock pin position. One condition may include establishing if the phaser 18 has attempted to disengage the lock pin 14 out of the recess 16 where, if the lock assembly 30 were not jammed, stuck, or being side-loaded, the lock assembly would be disengaged. Another condition may include establishing that the phaser 18 is at the lock, pin position, and yet another condition may include establishing if the phaser 18 is commanded to move away from the lock pin position. One more condition may include establishing that the global repetition counter is less than the global repetition counter limit.

In the repeat state 56, the method 10 may prepare to repeat an attempt at disengagement to try to disengage the lock pin 14 out of the recess 16. Upon entry, the source code may instruct the ECU 20 to perform various steps or commands. For instance, the ECU 20 may add one to the repetition counter, and the ECU 20 may command rate limiting.

Several more transitions may be provided between the repeat state 56 and the rate control state 54 to furnish one or more condition(s), action(s), or both for entering into the rate control state. A transition 68 may furnish a condition which may include establishing that the phaser 18 is at the lock pin position, and another condition may include establishing if the phaser 18 is commanded to move away from the lock pin position. Furthermore, another condition may include establishing that the global repetition counter is less than the global repetition counter limit. A transition 70 may furnish a condition which may include establishing that the repetition counter is greater than one. One action of the transition 70 may include adding one to the global repetition counter, and another action may include clearing the duty cycle so that the duty cycle starts again at 0%. Furthermore, a transition 72 may furnish an action which may include clearing the duty cycle. The above transitions are designed so that for the first repetition of an attempt to disengage the lock pin 14 for a particular cycle of the method 10, neither the global repetition counter nor the global timer are initiated. For example, when the method 10 performs the repeat state 56 for the first time in a cycle, the transition 72 is used for entering the rate control state 54, and the global repetition counter is not counted and the global timer is not incremented.

A transition 74 may be provided between the rate control state 54 and the wait state 58 to furnish one or more conditions(s), action(s), or both for entering into the wait state. One condition may include establishing that the phaser 18 is not at the lock pin position. Another condition may include establishing if the phaser 18 is commanded to be at the lock pin position. And another condition may include establishing that the global repetition counter is greater than or equal to the global repetition counter limit. Yet another condition may include establishing that the global timer is greater than or equal to the global timer limit. One action of the transition 74 may include clearing an integral value of the PID control.

A transition 76 may be provided between the repeat state 56 and the wait state 58 to furnish one or more condition(s), action(s), or both for entering into the wait state. One condition may include establishing that the phaser 18 is not at the lock pin position. Another condition may include establishing if the phaser 18 is commanded to be at the lock pin position. And another condition may include establishing that the global repetition counter is greater than or equal to the global repetition counter limit. Yet another condition may include establishing that the global timer is greater than or equal to the global timer limit. One action of the transition 76 may include clearing the integral value of the PID control.

Lastly, the wait state 58 may simply provide enough time between the rate control state 54 and the repeat state 56, and the normal state 50 for the various condition(s) and/or action(s) to be performed, such as clearing the integral value of the PID control.

When the method 10 is loaded onto a controller such as the ECU 20, the method is used in some circumstances to control the movement of the phaser 18 when the lock assembly 30 is being disengaged. In particular, the embodiment described limits the rate of movement of the phaser 18 when the lock assembly 30 is jammed, stuck, or being side-loaded so that the lock pin 14 has enough time to retract out of the recess 16. For example, from the normal state 50, the ECU 20 brings the VVT 12 into the debounce timer state 52 if the conditions of the transition 60 are met and performed, such, as the phaser 18 being located at the lock pin position. If the phaser 18 is commanded from the lock, pin position and is no longer located at the position, then the ECU 20 brings the VVT 12 back into the normal, state 50 by the transition 62. If, on the other hand, fee conditions of the transition 64 are met and performed, the ECU 20 brings the VVT 12 into the rate control state 54. In general, the conditions of the transition 64 can demonstrate that the lock pin 14 is extended into the recess 16 in the lock pin position, and that the ECU 20 is commanding the phaser 18 to move away from the lock pin position.

Once in the rate control state 54, there is a possibility that the lock pin assembly 30 is jammed, stuck, or being side-loaded at the lock pin position because, as demonstrated in the transition 64, the lock pin 14 is in the recess 16 and the phaser 18 is commanded away from the lock pin position. If at this point, for example, the phaser 18 is no longer located at the lock pin position, or any of the other conditions of the transition 74 are met, the ECU 20 brings the VVT 12 into the wait state 58 and then back into the normal state 50. But if the phaser 18 is still located at the lock pin position, there is again a possibility that the lock pin assembly 30 is jammed, stuck, or being side loaded; and if the VVT 12 meets the other conditions of the transition 66, the ECU 20 brings the VVT into the repeat state 56. Once in the repeat state 56, the VVT 12 will either follow the transition 76 or the transition 68. For example, if the phaser 18 is no longer at the lock pin position, or if the VVT 12 meets any of the other conditions of the transition 76, the ECU 20 brings the VVT into the wait state 58 and then back to the normal state 50.

But if the VVT 12 meets all of the conditions of the transition 68, the rate of movement of the phaser 18 might then be slowed by rate limiting. For instance, if this is the first time that the VVT 12 has followed the transition 68, the VVT follows the transition 72 into the rate control state 54. But if it is not the first time, say the second or third time, then the VVT 12 follows the transition 70 into the rate control state 54. In either case, in this embodiment the phaser 18 will be rate limited. As previously described, one way of rate limiting uses the rate reduction multiplier. For example, if the duty cycle rate without rate limiting is 50% per second and the initial rate reduction multiplier value is 0.7 for the particular engine, then the duty cycle rate is reduced to 35% per second for this initial repeated duty cycle. The reduced, duty cycle rate thus slows the rate of movement of the phaser 18. Now if the VVT 12 again meets the conditions of the transitions 66, 68, and 70, then the rate reduction multiplier can be decreased to 0.5 and the duty cycle rate would be reduced to 25% per second such that the rate of movement of the phaser 18 slows even more. The reduction multiplier can continually be decreased in this manner until the VVT 12 meets any of the conditions of transitions 74 or 76.

During the above duty cycle rate limit reductions, the rate may be only reduced, or rate limited between particular duty cycle percentages. For a complete attempt to disengage the lock pin 14, as previously described, the duty cycle goes from 0-100% from beginning to end. In some VVT systems though, the duty cycles adjacent the initial range of duty cycle (e.g., 0-10%) and adjacent the maximum range of duty cycle (e.g., 70-100%) do not translate into any significant change in rate of actuation of the vane 28 or the lock assembly 30. This being so, the duty cycle rates are not limited during those particular duty cycle percentages for a repeated duty cycle of the method 10, and may instead be sped up.

While certain preferred embodiments have been shown and described, persons of ordinary skill in this art will readily recognize that the preceding description has been set forth in terms of description rather than limitation, and that various modifications and substitutions can be made without departing from the spirit and scope of the invention. The invention is defined by the following claims.

What is claimed is:

1. A method of controlling the movement of a phaser of a variable valve timing (VVT) system when disengaging a lock pin, the method comprising:

establishing if the phaser is at a lock pin position;

establishing if the lock pin is not disengaged from a recess, of the phaser when the phaser is commanded to move away from the lock pin position; and if the lock pin is not disengaged, rate limiting the movement of the phaser away from the lock pin position so that the lock pin can be effectively disengaged out of the recess; and wherein rate limiting the movement of the phaser comprises rate limiting a duty cycle of the VVT system by applying a rate reduction multiplier so that the lock pin can be effectively disengaged out of the recess.

2. The method of claim 1 wherein establishing if the phaser is at a lock pin position further comprises establishing if the lock pin and the recess were aligned for a sufficient amount of rime whereby the lock pin could engage the recess, and establishing if a hydraulic force of the VVT system is less than a biasing force of a spring on the lock pin whereby the lock pin could engage the recess.

3. The method of claim 1 wherein establishing if the phaser is at a lock pin position further comprises establishing if fee the VVT system is at an engine start-up condition.

4. The method of claim 1 wherein establishing if the lock pin is not disengaged from the recess further comprises establishing if the VVT system has attempted to disengage the lock pin out of the recess, establishing if the phaser is at the lock pin position, and establishing if the phaser is commanded to move away from the lock pin position.

5. The method of claim 1 which also includes, before rate limiting the movement of the phaser, temporarily suspending the use of a diagnostic system that monitors the VVT system.

6. The method of claim 1 further comprising using an engine control unit (ECU) to control the movement of the phaser.

7. The method of claim 1 wherein rate limiting the duty cycle of the VVT system further comprises repeating the rate limiting for a predetermined number of times or until the lock pin is disengaged out of the recess, whichever occurs first.

8. The method of claim 1 wherein rate limiting the duty cycle of the VVT system further comprises repeating the rate limiting for a predetermined amount of time or until the lock pin is disengaged out of the recess, whichever occurs first.

9. The method of claim 8 wherein repeating the rate limiting further comprises continually decreasing the rate of movement of the phaser at each successive repetition by the rate reduction multiplier.

10. The method of claim 8 wherein repeating the rate limiting further comprises continually decreasing the race of movement of the phaser at each successive repetition by the rate reduction multiplier.

11. The method of claim 1 wherein rate limiting the duty cycle of the VVT system further comprises calculating the rate reduction multiplier based partly on a repetition counter.

12. The method of claim 1 wherein rate limiting the duty cycle of the VVT system further comprises speeding up the duty cycle when the duty cycle is adjacent an initial range of duty cycles and adjacent a maximum range of duty cycles.

13. A method of using a controller to control the phasing of a variable valve timing (VVT) system, the method comprising:

establishing if the VVT system is at a lock pin position;

establishing if a lock pin of the VVT system is not disengaged out of a recess of the VVT system when the controller commands the VVT system to move away from the lock pin position; and if the lock pin is not disengaged, rate limiting a duty cycle of the VVT system using a rate reduction multiplier based at least partly on a repetition counter to control the race of movement of the VVT system so that the lock pin can be disengaged out of the recess.

14. The method of claim 13 wherein race limiting the duty cycle further comprises repeating the rate limiting for a predetermined number of duty cycles or until the lock pin is disengaged out of the recess, whichever occurs first.

15. The method of claim 13 wherein rate limiting the duty cycle further comprises repeating the rate limiting for a predetermined amount of time or until the lock pin is disengaged out of the recess, whichever occurs first.

16. The method of claim 14 wherein repeating the rate limiting further comprises continually decreasing the rate of movement of the phaser at each successive repetition by a changing the rate reduction multiplier.

17. The method of claim 15 wherein repeating the rate limiting further comprises continually decreasing the rate of movement of the phaser at each successive repetition by a changing the rate reduction multiplier.

18. A method of controlling, the movement of a phaser of a variable valve timing (VVT) system, when disengaging a lock pin out of a recess, the method comprising:

establishing if the phaser is at a lock pin position;

establishing if the lock pin is not disengaged out of the recess when the phaser is commanded to move away from the lock pin position;

if the lock pin is not disengaged, rate limiting a duty cycle of the VVT system to control the rate of movement of the phaser so that the lock pin can be disengaged out of the recess; and repeating the rate limiting for a predetermined number of duty cycles reducing the duty cycle each successive duty cycle, or until the lock pin is disengaged out of the recess, whichever occurs first.

19. The method of claim 18 wherein rate limiting the duty cycle comprises multiplying the duty cycle by a rate reduction multiplier having a value less than one.

20. The method of claim 19 wherein reducing the duty cycle in each successive duty cycle when rate limiting is repeated comprises reducing the raw reduction multiplier for each successive duty cycle.

* * * * *